US009446879B2

(12) United States Patent
Chasteen et al.

(10) Patent No.: US 9,446,879 B2
(45) Date of Patent: Sep. 20, 2016

(54) CONTAINER END CLOSURE WITH OPTIONAL SECONDARY VENT OPENING

(71) Applicant: Ball Corporation, Broomfield, CO (US)

(72) Inventors: Howard C. Chasteen, Westminster, CO (US); Mark A. Jacober, Arvada, CO (US)

(73) Assignee: Ball Corporation, Broomfield, CO (US)

( * ) Notice: Subject to any disclaimer, the term of this patent is extended or adjusted under 35 U.S.C. 154(b) by 511 days.

(21) Appl. No.: 14/066,457

(22) Filed: Oct. 29, 2013

(65) Prior Publication Data

US 2014/0096491 A1 Apr. 10, 2014

Related U.S. Application Data

(63) Continuation of application No. 12/851,979, filed on Aug. 6, 2010, now Pat. No. 8,567,158.

(51) Int. Cl.
*B65D 17/00* (2006.01)

(52) U.S. Cl.
CPC ..... *B65D 17/24* (2013.01); *B65D 17/165* (2013.01); *B65D 2517/002* (2013.01); *B65D 2517/0014* (2013.01); *B65D 2517/0094* (2013.01)

(58) Field of Classification Search
CPC .... B65D 51/00; B65D 51/02; B62D 17/161; B62D 17/18; B62D 17/165
USPC ..... 53/381.1
See application file for complete search history.

(56) References Cited

U.S. PATENT DOCUMENTS

| | | | |
|---|---|---|---|
| 1,847,794 | A | 3/1932 | Takeda |
| 2,160,429 | A | 5/1939 | Bukolt |
| 2,272,111 | A | 2/1942 | Dove |
| 3,169,678 | A | 2/1965 | Wilkinson |
| 3,215,305 | A | 11/1965 | Frankenberg |
| 3,227,304 | A | 1/1966 | Asbury |
| 3,246,791 | A | 4/1966 | Asbury |
| 3,262,611 | A | 7/1966 | Palmer |
| 3,307,737 | A | 3/1967 | Harvey et al. |
| 3,326,406 | A | 6/1967 | Brown |

(Continued)

FOREIGN PATENT DOCUMENTS

| | | |
|---|---|---|
| CA | 2280461 | 2/2001 |
| CA | 2657391 | 1/2008 |

(Continued)

OTHER PUBLICATIONS

News Releases: "The Can, ReinVented: Louisville is Pilot Market for New Bud Light Vented Can" Anheuser-Busch InBev, Jun. 5, 2013, 3 pages.

(Continued)

*Primary Examiner* — Gloria R Weeks
(74) *Attorney, Agent, or Firm* — Sheridan Ross P.C.

(57) ABSTRACT

The present invention relates to an opening device for a beverage container. More specifically, the invention relates to a metal end closure having a primary opening area and at least one optional secondary vent opening which can be opened with the same pull tab. The primary opening area of the metal end closure may be opened by utilizing a pull tab interconnected to a central panel, the pull tab being adapted for applying a downward force to form a first opening. Subsequently, the pull tab is rotated and the tail end lifted to form a second opening in the end closure.

8 Claims, 7 Drawing Sheets

(56) References Cited

U.S. PATENT DOCUMENTS

| | | | |
|---|---|---|---|
| D208,591 | S | 9/1967 | Bozek |
| 3,362,569 | A | 1/1968 | Geiger |
| 3,370,169 | A | 2/1968 | Bozek |
| 3,441,169 | A | 4/1969 | Dunn et al. |
| 3,446,389 | A | 5/1969 | Brown |
| 3,499,573 | A | 3/1970 | Adams |
| 3,618,815 | A | 11/1971 | Heffner |
| 3,731,836 | A | 5/1973 | Silver |
| 3,741,432 | A | 6/1973 | Werth et al. |
| 3,744,667 | A | 7/1973 | Fraze et al. |
| 3,762,597 | A | 10/1973 | Kaminski et al. |
| 3,765,208 | A | 10/1973 | Cozert |
| 3,779,417 | A | 12/1973 | Klein |
| 3,794,206 | A | 2/1974 | De Line et al. |
| 3,826,401 | A | 7/1974 | Zundel |
| 3,833,144 | A | 9/1974 | Bollmann et al. |
| 3,836,038 | A | 9/1974 | Cudzik |
| 3,856,184 | A | 12/1974 | Luviano |
| 3,877,604 | A | 4/1975 | Brown |
| 3,881,630 | A | 5/1975 | Lovell et al. |
| 3,908,856 | A | 9/1975 | Perry |
| D238,150 | S | 12/1975 | Cudzik |
| D238,659 | S | 2/1976 | Wallace |
| D239,255 | S | 3/1976 | Brincks et al. |
| D239,256 | S | 3/1976 | Brincks et al. |
| RE28,910 | E | 7/1976 | Dalli et al. |
| 3,970,212 | A | 7/1976 | Brown |
| 3,982,657 | A | 9/1976 | Keller et al. |
| 4,024,981 | A | 5/1977 | Brown |
| 4,030,631 | A | 6/1977 | Brown |
| 4,032,034 | A | 6/1977 | Willis |
| 4,039,100 | A | 8/1977 | Wells |
| 4,051,976 | A | 10/1977 | Perry |
| 4,054,228 | A | 10/1977 | Balocca et al. |
| 4,061,243 | A | 12/1977 | Khoury |
| 4,062,471 | A | 12/1977 | Perry et al. |
| 4,073,403 | A | 2/1978 | Orange |
| 4,084,721 | A | 4/1978 | Perry |
| 4,105,133 | A | 8/1978 | La Barge et al. |
| 4,128,186 | A | 12/1978 | Gane |
| 4,146,149 | A | 3/1979 | Beveridge |
| 4,148,410 | A | 4/1979 | Brown |
| 4,184,607 | A | 1/1980 | Potts |
| 4,196,823 | A | 4/1980 | Madden et al. |
| D255,424 | S | 6/1980 | Bathurst |
| D255,425 | S | 6/1980 | Bathurst |
| 4,205,760 | A | 6/1980 | Hasegawa |
| RE30,349 | E | 7/1980 | Silver |
| 4,210,257 | A | 7/1980 | Radtke |
| 4,213,538 | A | 7/1980 | Boardman |
| 4,244,489 | A | 1/1981 | Klein |
| 4,244,490 | A | 1/1981 | Klein |
| 4,252,247 | A | 2/1981 | Asbury |
| 4,257,529 | A | 3/1981 | Saunders |
| 4,267,938 | A | 5/1981 | Debenham et al. |
| D259,403 | S | 6/1981 | Frazier |
| 4,276,993 | A | 7/1981 | Hasegawa |
| 4,280,427 | A | 7/1981 | Potts |
| 4,289,251 | A | 9/1981 | Maliszewski |
| 4,305,523 | A | 12/1981 | Dalli et al. |
| 4,318,494 | A | 3/1982 | Heyn |
| 4,320,850 | A | 3/1982 | Drolen, Jr. |
| 4,361,251 | A | 11/1982 | Langseder et al. |
| D267,633 | S | 1/1983 | Christian |
| 4,397,403 | A | 8/1983 | Guimarin |
| 4,402,421 | A | 9/1983 | Ruemer, Jr. |
| 4,416,389 | A | 11/1983 | Wilkinson et al. |
| 4,438,865 | A | 3/1984 | Scattaregia |
| 4,448,325 | A | 5/1984 | Edwards et al. |
| 4,465,204 | A | 8/1984 | Kaminski et al. |
| 4,576,306 | A | 3/1986 | Kelsey et al. |
| 4,701,090 | A | 10/1987 | Smith |
| 4,901,880 | A | 2/1990 | Tatham et al. |
| 4,930,658 | A | 6/1990 | McEldowney |
| 4,994,009 | A | 2/1991 | McEldowney |
| 5,007,554 | A | 4/1991 | Hannon et al. |
| 5,011,037 | A | 4/1991 | Moen et al. |
| 5,064,087 | A | 11/1991 | Koch |
| 5,065,882 | A | 11/1991 | Sugiyama |
| 5,129,541 | A | 7/1992 | Voigt et al. |
| 5,131,555 | A | 7/1992 | DeMars et al. |
| 5,219,257 | A | 6/1993 | Koch |
| 5,224,618 | A | 7/1993 | Garbiso |
| 5,248,053 | A | 9/1993 | Lundgren |
| 5,285,919 | A | 2/1994 | Recchia |
| 5,307,947 | A | 5/1994 | Moen et al. |
| D353,769 | S | 12/1994 | Miller |
| 5,375,729 | A | 12/1994 | Schubert |
| 5,397,014 | A | 3/1995 | Aydt |
| 5,405,039 | A | 4/1995 | Komura |
| 5,456,378 | A | 10/1995 | DeMars |
| D365,274 | S | 12/1995 | Cook |
| 5,494,184 | A | 2/1996 | Noguchi et al. |
| 5,555,992 | A | 9/1996 | Sedgeley |
| D382,481 | S | 8/1997 | McEldowney |
| 5,653,355 | A | 8/1997 | Tominaga et al. |
| 5,655,678 | A | 8/1997 | Kobayashi |
| D385,192 | S | 10/1997 | Hurst et al. |
| 5,683,006 | A | 11/1997 | Cook, III |
| D387,987 | S | 12/1997 | Neiner |
| 5,692,636 | A | 12/1997 | Schubert |
| 5,695,085 | A | 12/1997 | Hadener |
| 5,711,448 | A | 1/1998 | Clarke, III |
| 5,713,481 | A | 2/1998 | Jordan |
| 5,715,964 | A | 2/1998 | Turner et al. |
| D396,635 | S | 8/1998 | McEldowney |
| D397,296 | S | 8/1998 | McEldowney et al. |
| 5,819,973 | A | 10/1998 | Traub, Sr. et al. |
| D402,887 | S | 12/1998 | Hurst |
| 5,860,553 | A | 1/1999 | Schubert |
| 5,911,331 | A | 6/1999 | Boller |
| D415,026 | S | 10/1999 | Turner et al. |
| 5,964,366 | A | 10/1999 | Hurst et al. |
| 5,975,327 | A | 11/1999 | Funk |
| 5,979,697 | A | 11/1999 | Kim |
| 6,024,239 | A | 2/2000 | Turner et al. |
| 6,050,440 | A | 4/2000 | McEldowney |
| D424,438 | S | 5/2000 | Turner et al. |
| 6,059,137 | A | 5/2000 | Westwood et al. |
| 6,079,583 | A | 6/2000 | Chasteen |
| 6,131,763 | A | 10/2000 | Stanish et al. |
| 6,145,866 | A | 11/2000 | Peter |
| D434,983 | S | 12/2000 | Hurst |
| 6,161,717 | A | 12/2000 | Forrest et al. |
| 6,202,880 | B1 | 3/2001 | Strube et al. |
| D448,666 | S | 10/2001 | Fields |
| 6,330,954 | B1 | 12/2001 | Turner et al. |
| 6,354,453 | B1 | 3/2002 | Chasteen |
| 6,375,029 | B2 | 4/2002 | Anthony et al. |
| 6,499,329 | B1 | 12/2002 | Enoki et al. |
| D476,889 | S | 7/2003 | Fields |
| 6,715,629 | B2 | 4/2004 | Hartman et al. |
| 6,761,281 | B2 | 7/2004 | Hartman |
| 6,837,093 | B2 | 1/2005 | Yamasaki |
| 7,000,797 | B2 | 2/2006 | Forrest et al. |
| 7,096,759 | B2 | 8/2006 | Kirko |
| 7,100,789 | B2 | 9/2006 | Nguyen et al. |
| D535,561 | S | 1/2007 | Smith et al. |
| D559,680 | S | 1/2008 | Jacober et al. |
| D579,771 | S | 11/2008 | Cherian |
| 7,506,779 | B2 | 3/2009 | Jentzsch et al. |
| 7,513,383 | B2 | 4/2009 | Hwang |
| 7,516,869 | B1 | 4/2009 | Hajianpour |
| D600,116 | S | 9/2009 | Cherian |
| D602,776 | S | 10/2009 | Cherian |
| D612,724 | S | 3/2010 | Cherian |
| 7,748,557 | B2 | 7/2010 | Robinson |
| D623,963 | S | 9/2010 | Fairchild et al. |
| 7,891,519 | B2 | 2/2011 | Matsukawa et al. |
| 7,918,359 | B2 | 4/2011 | Paris et al. |
| 7,975,884 | B2 | 7/2011 | Mathabel et al. |
| D650,276 | S | 12/2011 | Nesling et al. |
| D650,277 | S | 12/2011 | Nesling et al. |
| D650,278 | S | 12/2011 | Nesling et al. |

(56) References Cited

U.S. PATENT DOCUMENTS

| | | | |
|---|---|---|---|
| D653,538 | S | 2/2012 | Toms et al. |
| D653,944 | S | 2/2012 | Seki et al. |
| 8,136,689 | B2 | 3/2012 | Ulstein et al. |
| 8,152,016 | B2 | 4/2012 | Berndt et al. |
| 8,177,092 | B2 | 5/2012 | Mills |
| 8,245,866 | B2 | 8/2012 | Gibson et al. |
| 8,336,726 | B2 | 12/2012 | Ramsey et al. |
| 8,397,935 | B2 | 3/2013 | Emanuele, III et al. |
| D691,039 | S | 10/2013 | Jacober et al. |
| 8,567,158 | B2 | 10/2013 | Chasteen et al. |
| 8,573,432 | B2 | 11/2013 | Emanuele, III et al. |
| 8,627,979 | B2 | 1/2014 | Thibaut et al. |
| 8,646,643 | B2 | 2/2014 | Forrest et al. |
| D704,555 | S | 5/2014 | Hernandez |
| 8,893,913 | B2 | 11/2014 | McClung et al. |
| 8,939,306 | B2 | 1/2015 | Rios |
| 8,950,619 | B2 | 2/2015 | Bork |
| 8,998,015 | B2 | 4/2015 | Williams et al. |
| 9,033,174 | B2 | 5/2015 | Chasteen et al. |
| 9,233,784 | B2 * | 1/2016 | Jacober ..... B65D 51/00 |
| 2002/0005408 | A1 | 1/2002 | Yamasaki et al. |
| 2002/0113069 | A1 | 8/2002 | Forrest et al. |
| 2002/0139800 | A1 | 10/2002 | Hwang et al. |
| 2003/0038134 | A1 | 2/2003 | Chasteen et al. |
| 2003/0075544 | A1 | 4/2003 | Turner et al. |
| 2003/0098306 | A1 | 5/2003 | Cho |
| 2003/0192889 | A1 | 10/2003 | Chasteen et al. |
| 2004/0056032 | A1 | 3/2004 | Vaughan |
| 2004/0140309 | A1 | 7/2004 | Thibaut |
| 2004/0144787 | A1 | 7/2004 | Heck |
| 2004/0188440 | A1 | 9/2004 | Schlattl et al. |
| 2004/0211786 | A1 | 10/2004 | Turner et al. |
| 2005/0077316 | A1 | 4/2005 | Roberts |
| 2005/0115976 | A1 | 6/2005 | Watson et al. |
| 2005/0224497 | A1 | 10/2005 | Wook |
| 2006/0049196 | A1 | 3/2006 | Price |
| 2006/0196875 | A1 | 9/2006 | Cherian |
| 2007/0039961 | A1 | 2/2007 | McEldowney et al. |
| 2007/0045318 | A1 | 3/2007 | Gibson et al. |
| 2007/0068943 | A1 | 3/2007 | Ramsey et al. |
| 2007/0138178 | A1 | 6/2007 | Erickson |
| 2007/0175896 | A1 | 8/2007 | Bursztein |
| 2007/0215621 | A1 | 9/2007 | Shinguryo et al. |
| 2007/0257035 | A1 | 11/2007 | Berndt et al. |
| 2008/0011786 | A1 | 1/2008 | Mathabel et al. |
| 2008/0110888 | A1 | 5/2008 | Turner et al. |
| 2008/0302793 | A1 | 12/2008 | Tirosh et al. |
| 2009/0001081 | A1 | 1/2009 | Schlattl et al. |
| 2009/0039090 | A1 | 2/2009 | Forrest et al. |
| 2009/0039091 | A1 | 2/2009 | Forrest et al. |
| 2009/0057315 | A1 | 3/2009 | Stringfield et al. |
| 2009/0173740 | A1 | 7/2009 | Ferguson |
| 2009/0194536 | A1 | 8/2009 | Ulstein et al. |
| 2009/0200305 | A1 | 8/2009 | Stude |
| 2009/0206083 | A1 | 8/2009 | Heigl |
| 2009/0266824 | A1 | 10/2009 | Turner et al. |
| 2009/0269169 | A1 | 10/2009 | Turner et al. |
| 2010/0000997 | A1 | 1/2010 | Southers |
| 2010/0018976 | A1 | 1/2010 | Christian et al. |
| 2010/0044383 | A1 | 2/2010 | Watson et al. |
| 2010/0224511 | A1 | 9/2010 | Boatner |
| 2010/0251731 | A1 | 10/2010 | Bergida |
| 2010/0294771 | A1 | 11/2010 | Holder et al. |
| 2010/0326281 | A1 | 12/2010 | Nishibe et al. |
| 2011/0056946 | A1 | 3/2011 | Emanuele, III et al. |
| 2011/0108552 | A1 | 5/2011 | Rios |
| 2011/0168714 | A1 | 7/2011 | Renz |
| 2011/0226636 | A1 | 9/2011 | Petti |
| 2011/0240645 | A1 | 10/2011 | Schley et al. |
| 2011/0253719 | A1 | 10/2011 | Cherian |
| 2011/0266281 | A1 | 11/2011 | Thiemann et al. |
| 2011/0297679 | A1 | 12/2011 | Gogola et al. |
| 2011/0303672 | A1 | 12/2011 | Fields et al. |
| 2012/0012584 | A1 | 1/2012 | Chameroy et al. |
| 2012/0048870 | A1 | 3/2012 | Ellerbe, III et al. |
| 2012/0199586 | A1 | 8/2012 | Shamalta |
| 2012/0199587 | A1 | 8/2012 | Norris |
| 2012/0205378 | A1 | 8/2012 | Forrest |
| 2012/0228296 | A1 | 9/2012 | Fields |
| 2012/0260613 | A1 | 10/2012 | Holder et al. |
| 2012/0312815 | A1 | 12/2012 | Ramsey et al. |
| 2013/0037542 | A1 | 2/2013 | Crothers |
| 2013/0037543 | A1 | 2/2013 | McClung et al. |
| 2013/0075401 | A1 | 3/2013 | Forrest |
| 2013/0118133 | A1 | 5/2013 | Jacober et al. |
| 2013/0126529 | A1 | 5/2013 | Nesling et al. |
| 2013/0264343 | A1 | 10/2013 | Neiner |
| 2013/0264344 | A1 | 10/2013 | Neiner et al. |
| 2013/0270267 | A1 | 10/2013 | Ramsey et al. |
| 2013/0270269 | A1 | 10/2013 | Lewis |
| 2013/0292382 | A1 | 11/2013 | Bork |
| 2013/0299496 | A1 | 11/2013 | Forrest et al. |
| 2014/0054290 | A1 | 2/2014 | McClung et al. |
| 2014/0054332 | A1 | 2/2014 | Mcclung et al. |
| 2014/0069924 | A1 | 3/2014 | Malaviya |
| 2014/0103044 | A1 | 4/2014 | Ramsey et al. |
| 2014/0110408 | A1 | 4/2014 | Mitchell et al. |
| 2014/0158685 | A1 | 6/2014 | Thiemann et al. |
| 2014/0263327 | A1 | 9/2014 | Chasteen et al. |
| 2014/0263333 | A1 | 9/2014 | Keane et al. |
| 2014/0325943 | A1 | 11/2014 | Fesler |
| 2014/0367382 | A1 | 12/2014 | Neiner et al. |
| 2014/0374419 | A1 | 12/2014 | Neiner |
| 2015/0034648 | A1 | 2/2015 | Wilson |
| 2015/0053681 | A1 | 2/2015 | McClung et al. |
| 2015/0136776 | A1 | 5/2015 | Chasteen et al. |
| 2015/0158627 | A1 | 6/2015 | Ramsey et al. |

FOREIGN PATENT DOCUMENTS

| | | |
|---|---|---|
| CN | 201343207 | 11/2009 |
| EP | 2038178 | 10/2010 |
| ES | 2458098 | 4/2014 |
| ES | 2525589 | 12/2014 |
| GB | 1436617 | 5/1976 |
| GB | 1532081 | 11/1978 |
| GB | 2280165 | 1/1995 |
| GB | 2291030 | 1/1996 |
| GB | 2320008 | 6/1998 |
| JP | H04-311452 | 11/1992 |
| JP | H05-178345 | 7/1993 |
| JP | H06-219448 | 8/1994 |
| JP | 3009188 U | 3/1995 |
| JP | H07-132936 | 5/1995 |
| JP | H07-132937 | 5/1995 |
| JP | H08-151043 | 6/1996 |
| JP | H09-58681 | 3/1997 |
| JP | H09-301364 | 11/1997 |
| JP | 10-035662 | 2/1998 |
| JP | H10-245032 | 9/1998 |
| JP | 2001-18960 | 1/2001 |
| JP | 2003285837 | 10/2003 |
| JP | 3578797 | 10/2004 |
| JP | 2004359339 | 12/2004 |
| JP | 2005088961 | 4/2005 |
| JP | 2006-069605 | 3/2006 |
| JP | 2007-22541 | 2/2007 |
| JP | 2009-543737 | 12/2009 |
| JP | 2010-215291 | 9/2010 |
| JP | 4879759 | 2/2012 |
| JP | 2013-531590 | 8/2013 |
| KR | 20050059718 | 6/2005 |
| NL | 1023297 | 11/2004 |
| WO | WO 94/13544 | 6/1994 |
| WO | WO 96/02432 | 2/1996 |
| WO | WO 97/22531 | 6/1997 |
| WO | WO 97/42088 | 11/1997 |
| WO | WO 00/56613 | 9/2000 |
| WO | WO 01/46025 | 6/2001 |
| WO | WO 2008/008892 | 1/2008 |
| WO | WO 2008/023983 | 2/2008 |
| WO | WO 2008/057207 | 5/2008 |
| WO | WO 2011/053776 | 5/2011 |
| WO | WO 2012/018549 | 2/2012 |

(56) References Cited

FOREIGN PATENT DOCUMENTS

| | | |
|---|---|---|
| WO | WO 2012/143322 | 10/2012 |
| WO | WO 2013/102594 | 7/2013 |
| WO | WO 2013/102595 | 7/2013 |

OTHER PUBLICATIONS

Press Release: "Crown and Molson Coors Debut Cans with New Vented End in Canada," Crown Holdings, Inc., Jul. 11, 2013, 2 pages.
Notice of Allowance for Australia Patent Application No. 2011286291, dated Apr. 3, 2014 2 pages.
Notice of Allowance (no English translation available) for Russian Patent Application No. 2013501911 dated Feb. 27, 2014, 2 pages.
U.S. Appl. No. 14/198,174, filed Mar. 5, 2014, Scott.
"How Ball Makes Beverage Ends," Ball, last modified Dec. 5, 2013, 1 page [retrieved from: http://www.ball.com/images/ball_com/product_options_files/How_Ball_Makes_Beverage_Ends.pdf].
International Search Report and Written Opinion for International (PCT) Application No. PCT/US14/20821 mailed Jun. 24, 2014, 9 pages.
Official Action for U.S. Appl. No. 29/464,785 mailed Jun. 24, 2014, 7 pages.
Notice of Allowance for U.S. Appl. No. 29/437,073 mailed Jun. 26, 2014, 10 pages.
Notice of Allowance for U.S. Appl. No. 29/438,299 mailed Jun. 26, 2014, 8 pages.
Official Action (with English translation) for Chinese Patent Application No. 201180046744.1, dated Jul. 1, 2014, 16 pages.
U.S. Appl. No. 29/502,091, filed Sep. 11, 2014, Scott.
U.S. Appl. No. 29/502,090, filed Sep. 11, 2014, Jacober et al.
U.S. Appl. No. 29/519,457, filed Mar. 5, 2015, Jacober et al.
U.S. Appl. No. 29/519,461, filed Mar. 5, 2015, Jacober et al.
U.S. Appl. No. 14/812,146, filed Jul. 29, 2015, Chasteen et al.
U.S. Appl. No. 14/812,549, filed Jul. 29, 2015, Chasteen et al.
Official Action (with English translation) for Chinese Patent Application No. 201180046744.1, dated Feb. 6, 2015, 7 pages.
Notice of Allowance with English Translation for China Patent Application No. 201180046744.1, dated May 11, 2015 4 pages.
Official Action with English Translation for Russia Patent Application No. 2013109931/12, daetd Jul. 21, 2015 7 pages.
International Preliminary Report on Patentability for International (PCT) Patent Application No. PCT/US2012/063384, mailed May 14, 2015 7 pages.
Official Action for Australia Patent Application No. 2012332214, dated Jun. 10, 2015 3 pages.
Official Action for U.S. Appl. No. 13/667,928, mailed Jul. 8, 2015 21 pages.
Notice of Allowance for U.S. Appl. No. 13/667,928, mailed Aug. 26, 2015 9 pages.
Official Action for U.S. Appl. No. 29/502,091, mailed Jul. 31, 2015 6 pages.
Official Action for U.S. Appl. No. 29/502,090, mailed Jul. 31, 2015 7 pages.
U.S. Appl. No. 14/877,743, filed Oct. 7, 2015, Jacober et al.
Murray "Vented can ends give Coors a smoother pour," thedrinksreport, Jul. 12, 2013, 3 pages [retrieved from: http://www.thedrinksreport.com/news/2013/14996-vented-can-ends-give-coors-a-smoother-pour.html].
International Preliminary Report on Patentability for International (PCT) Patent Application No. PCT/US2014/020821, mailed Sep. 24, 2015 8 pages.
Notice of Allowance for U.S. Appl. No. 29/502,091, mailed Oct. 1, 2015 6 pages.
Notice of Allowance for U.S. Appl. No. 29/502,090, mailed Oct. 14, 2015 7 pages.
Extended European Search Report for European Patent Application No. 11815019.2 dated Mar. 27, 2014,7 pages.
Official Action for Canadian Patent Application No. 150953 dated Feb. 26, 2014, 2 pages.
Official Action for Canadian Patent Application No. 151227 dated Feb. 26, 2014, 2 pages.
Official Action for U.S. Appl. No. 29/437,073 mailed Apr. 9, 2014, 6 pages.
Official Action for U.S. Appl. No. 29/438,299 mailed Apr. 9, 2014, 7 pages.
Official Action for Australia Patent Application No. 2011286291, dated Dec. 12, 2013 3 pages.
U.S. Appl. No. 29/437,073, filed Nov. 13, 2012, Scott.
U.S. Appl. No. 29/438,299, filed Nov. 28, 2012, Jacober et al.
U.S. Appl. No. 29/464,785, filed Aug. 21, 2013, Jacober et al.
International Search Report for International (PCT) Application No. PCT/US11/44940, mailed Dec. 22, 2011, 3 pages.
Written Opinion for International (PCT) Application No. PCT/US11/44940, mailed Dec. 22, 2011, 5 pages.
International Preliminary Report on Patentability for International (PCT) Application No. PCT/US11/44940, mailed Feb. 21, 2013, 7 pages.
Official Action for Canadian Patent Application No. 2,806,879 dated Oct. 23, 2013, 2 pages.
International Search Report and Written Opinion for International (PCT) Application No. PCT/US12/63384 mailed Feb. 1, 2013, 8 pages.
Official Action for Canada Patent Application No. 144505, dated Jun. 13, 2012 2 pages.
English translation of Notice of Allowance for China Patent Application No. 201230127943.2, dated Aug. 20, 2012 2 pages.
Notice of Allowance with English Translation for China Patent Application No. 201330161204.X, dated Oct. 16, 2013 4 pages.
Notice of Allowance with English Translation for China Patent Application No. 201330204259.4, dated Sep. 26, 2013 4 pages.
Official Action for U.S. Appl. No. 12/851,979, mailed Sep. 28, 2012 10 pages.
Final Action for U.S. Appl. No. 12/851,979, mailed Apr. 29, 2013, 11 pages.
Notice of Allowance for U.S. Appl. No. 12/851,979, mailed Jul. 11, 2013, 8 pages.
Official Action for U.S. Appl. No. 29/404,996 mailed Apr. 12, 2013, 5 pages.
Notice of Allowance for U.S. Appl. No. 29/404,996 mailed May 30, 2013, 7 pages.

* cited by examiner

CONTAINER END CLOSURE WITH OPTIONAL SECONDARY VENT OPENING

This U.S. Non-Provisional Patent application is a Continuation of U.S. patent application Ser. No. 12/851,979, filed Aug. 6, 2010, now U.S. Pat. No. 8,567,158, the entire disclosure of which is hereby incorporated by reference in its entirety.

FIELD OF THE INVENTION

The present invention relates to an end closure for a beverage container. More specifically, the present invention relates to an end closure for a container which comprises a first opening portion and at least one secondary opening portion to enhance venting and improve outflow of the product during pouring.

BACKGROUND OF THE INVENTION

Containers and more specifically metallic beverage containers are typically manufactured by interconnecting a beverage container end closure to the neck of a beverage container body. In some applications, an end closure may be interconnected on both a top side and a bottom side of a container body. More frequently, however, a beverage container end closure is interconnected on a top end of a beverage container body which has been drawn and ironed from a flat sheet of blank material such as aluminum. It is generally known to provide end closures for beverage containers, and which utilize an opening device for selectively opening a portion of the end closure. For example, pull tabs or stay on tabs ("SOT") generally include a nose and a tail portion and a rivet which interconnects the pull tab to the upper surface of the end closure. The tail portion generally has a loop or tail that may be pulled upwardly by a user which drives the nose portion of the pull tab downward to initiate the opening of the container by shearing a score line which defines the primary opening to the end closure.

Conventional beverage container end closures with SOT's generally suffer from low, inconsistent, and/or uneven flow rates as the contents in the container are poured due to the fact that these end closures provide a single opening area of predetermined size. Conventional container end closures are generally designed for pouring the container contents, with little or no consideration given to inward air flow needed for the volume exchange that facilitates smooth and consistent pouring.

Various patents have attempted to improve end closure pourability by creating one or more openings. These patents include U.S. Pat. No. 7,513,383 to Hwang and U.S. Pat. No. 4,289,251 to Maliszewski, which are incorporated herein by reference in their entireties. Hwang discloses an opening device for a can, with distinct first and second opening portions so that the fluid may flow more consistently from the can. Hwang, however, fails to teach various novel features of the present invention, including a secondary opening portion which may be selectively opened in order to complement or facilitate flow rate through a primary opening portion, and by rotating the pull tab to a preferred orientation. Maliszewski discloses a container end closure with a first score line defining a first displaceable panel portion and second score line defining a second displaceable panel portion. Maliszewski, however, fails to teach various novel features of the present invention, including a secondary opening portion which may be selectively opened in order to complement or facilitate flow rates through a primary opening portion.

The following disclosure describes an improved container end closure which is adapted for interconnection to a container body and which has a first opening portion, a rotatable tab, and at least one additional vent opening for selectively facilitating the flow rate of contents from within the container.

SUMMARY OF THE INVENTION

Based on the limitations of end closures discussed above, there is an unmet need for an end closure with a pull tab, a primary opening area, and at least one optional additional opening area to facilitate the pouring of contents from a container. There has further been a long-felt and unmet need to provide such a device wherein an additional opening area is selectively activated or opened based on a user's preference, and utilizing the same mechanics of the existing pull tab mounted on the end closure. The following disclosure generally describes a metal end closure with a pull tab and a plurality of opening areas that employs a novel combination of features that address these long felt needs.

In one aspect of the present invention, a container end closure is provided with a primary opening portion and at least one additional opening portion which may be selectively opened by a user to create improved flow characteristics due to a larger opened area and/or an area which allows for air intake into a container body through one or more vent openings while contents flow out through another opening.

In various embodiments, container end closures of the present invention are adapted for connection with a neck of a container body. More specifically, the end closure generally comprises a peripheral curl for double seaming to a neck of a container, a chuck wall extending downwardly from the peripheral curl, a countersink comprised of an outer panel wall and an inner panel wall, and a central panel extending inwardly from the inner panel wall of the countersink. For the purposes of further supporting and enabling the present disclosure, U.S. Pat. No. 7,506,779 to Jentzsch et al. entitled "Method and Apparatus for Forming a Reinforcing Bead in a Container End Closure" and U.S. Pat. No. 7,100,789 to Nguyen et al. entitled "Metallic Beverage Can End With Improved Chuck Wall and Countersink" are incorporated by reference herein in their entireties.

It is another aspect of the present invention to provide an end closure with a primary opening where a tab is interconnected to a central panel unit, a rivet for rotatably securing the tab on the end closure, a secondary score line which defines a secondary opening area, and a transition zone between the primary and secondary openings. In one embodiment, first and second opening areas are positioned adjacent to one another and the transition zone prevents opening of a secondary opening area when the tab is utilized to open the first opening area. For example, in one embodiment, the transition zone inhibits the propagation of a primary score line into a secondary score line or opening area. Alternatively, the first and second opening areas are not positioned adjacent to each other, but rather are spaced in distinct locations.

It is another aspect of the present invention to provide a rotatable tab which is capable of opening a gate defined within a first opening area through a first opening movement or lifting of the tab, and which is subsequently capable of being rotated and utilized to open a secondary opening area through a second opening movement. Thus, a user can selectively determine whether they want to utilize the secondary opening for venting, or drink from the container in a conventional manner from the primary opening without the increased flow resulting from venting.

It is another aspect of the present invention to provide a tab with one or more features which limit or otherwise define the amount of desirable or necessary rotation needed in order to reposition the tab for opening one or more secondary opening areas of a control panel. For example, features of the present invention may include recessions or cut outs within a tab and corresponding protrusions or detents on the central panel which restrict the tab from rotating about a rivet beyond a predetermined orientation. In an alternative embodiment, a portion of a central panel of the present invention is adapted to receive a tab and thus limit the amount of rotation of a tab from an initial position. In one embodiment, a tab is rotatable on an end closure central panel between an angle of zero degrees (i.e. with respect to an initial position) and +/−90 degrees. In an alternative embodiment, a tab is rotatable about an axis substantially parallel to a horizontal plane of a central panel between an angle of zero degrees (i.e. with respect to an initial position) and +/−45 degrees.

In another embodiment, an end closure is provided that has at least first and secondary opening portions, wherein the first and secondary opening portions may be opened without the need to rotate a tab. For example, in one embodiment, the present invention comprises a first opening area defined by a score line and a gate contained therein, the score line adapted to be severed and the gate opened by the tilting of the tab. The second opening area is defined by a secondary score line and a transition zone, the transition zone inhibiting the propagation of a the primary score line and requiring a user to exert an additional or distinct force (i.e. as compared to the force applied to open the primary opening portion) in order to open the secondary opening portion. Thus, in one embodiment, a first and second opening portion may be opened in series through the application of one or more forces, wherein the opening of the second opening portion is distinct from the first due to, for example, a transition zone. Thus, in one embodiment, a tab need not be rotated about a longitudinal axis of a container body and end closure combination in order to sever or open a secondary opening area.

In one embodiment, an end closure adapted for connection to a container body is provided. The metal end closure comprises a substantially planar central panel, and force applying means for applying inwardly directed forces on the central panel. Force applying means may include, by way of example only, a tab having a loop or tail portion and nose portion, wherein the tab is connected to an end closure with a rivet.

In alternative embodiments, an end closure does not comprise a tab portion as found on various SOTs. Rather, in certain embodiments, an end closure is provided with a primary opening area/portion and at least one secondary selectively opening area/portion wherein said first and secondary opening areas are scored or severed away from a panel with an additional tool. Additional tools comprise, but are not limited to, known can openers and similar devices adapted for opening or tearing a central panel. In one embodiment, force applying means comprise a tool or object which is not joined or attached to the end closure. For example, various known bottle openers, "church keys," and similar devices adapted for applying a force to an end closure may be provided.

In one embodiment, pivot means are permanently mounted on said central panel for pivotally mounting the force applying means on the central panel. Pivot means may include, for example, a rivet attached to a portion of a central panel and a rivet island or similar rivet receiving portion disposed on a tab. Thus, in various embodiments, pivot means are provided which allow for a tab to rotate about an axis generally parallel with a longitudinal axis of an end closure/container combination, yet generally prevent the inadvertent displacement of a tab from a central panel. Rotational limiting means may be provided on the end closure and adapted for limiting the amount of rotation of the force applying means. Rotational limiting means of the present invention include, but are not limited to, detents, protrusions, recessions, and various other features formed or placed on a central panel and adapted for contacting a tab and/or supplying visual indication of a desirable orientation of a tab.

A first opening portion having a severable score line is provided in one embodiment, the severable score line defining the first opening portion and a first hinge portion integral with the central panel. In one embodiment, a second opening portion is provided which comprises a severable score line defining the second opening portion and a second hinge portion integral with the central panel, and a transition portion which substantially prevents a fracture propagation of said severable score line of said first opening portion into said severable score line of said second opening portion.

It is another aspect of the present invention to provide a method of opening a container, i.e., enhancing the pourability of a container. This includes, but is not limited to a method comprising the steps opening a primary opening area wherein force applying means are tilted to apply a first downward force on a first opening portion to sever a first severable score line. Subsequently, the force applying means (e.g. pull tab) is at least partially restored to a first initial position and the force applying means is rotated such that a nose portion of the force applying means is positioned over a portion of a second opening portion and the force applying means is tilted to apply a second downward force on a second opening portion to sever a second score line. Alternatively, a third opening could be formed in alternative embodiments by further rotation of the pull tab and severing a third opening. In embodiments, similar steps may be repeated so as to open one or more additional venting portions disposed on an end closure.

These and other advantages will be apparent from the disclosure of the invention(s) contained herein. The above-described embodiments, objectives, and configurations are neither complete nor exhaustive. As will be appreciated, other embodiments of the invention are possible using, alone or in combination, one or more of the features set forth above or described in detail below. Further, the summary of the invention is neither intended nor should it be construed as being representative of the full extent and scope of the present invention. The present invention is set forth in various levels of detail in the summary of the invention, as well as in the attached drawings and the detailed description of the invention and no limitation as to the scope of the present invention is intended to either the inclusion or non-inclusion of elements, components, etc. in this summary of the invention. Additional aspects of the present invention will become more readily apparent from the detailed description, particularly when taken together with the drawings.

BRIEF DESCRIPTION OF THE DRAWINGS

The accompanying drawings, which are incorporated in and constitute part of the specification, illustrate various embodiments of the present invention and together with the general description of the invention given above serve to explain the principle of these inventions.

Figure 1:
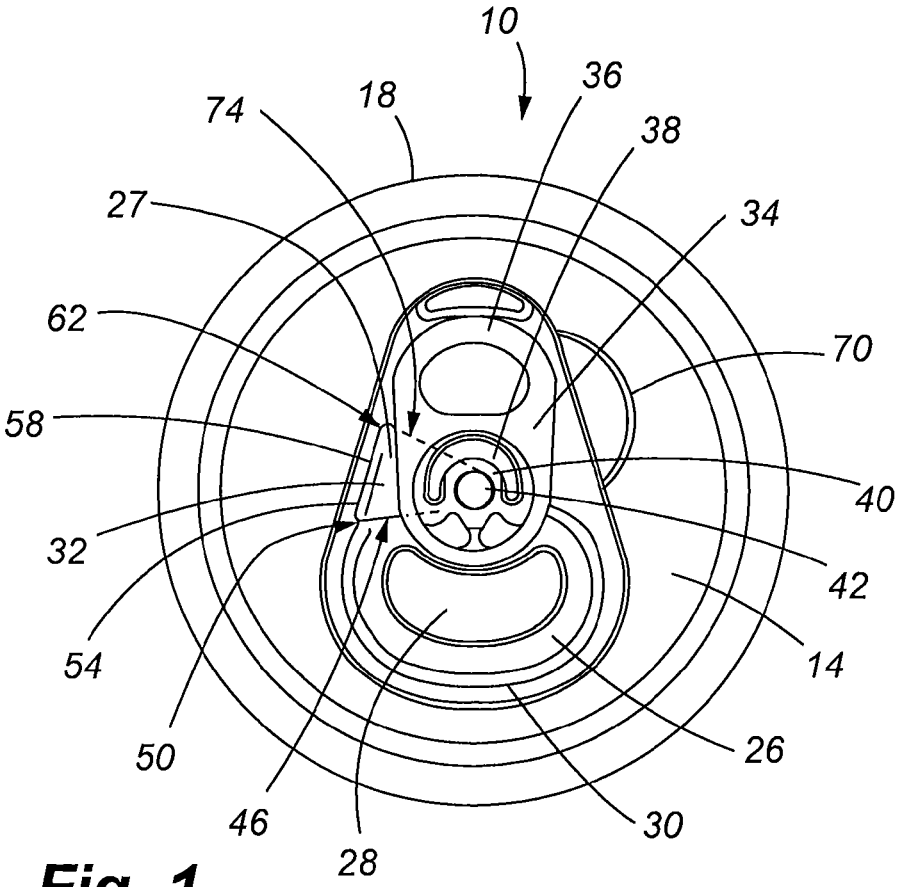
FIG. 1 is a top plan view of a metal end closure according to one embodiment wherein a tab and a first opening portion are in a first closed position.

To further assist in the understanding of the invention, the following is a table of components found in the drawings and associated numbering.

| | |
|---|---|
| 10 | End Closure and Container Body |
| 14 | Panel |
| 18 | Peripheral Curl |
| 26 | Gate |
| 27 | Secondary Gate |
| 28 | Primary Opening Area |
| 30 | Primary Score |
| 32 | Secondary Opening Area |
| 33 | Third Opening Area |
| 34 | Tab |
| 35 | Nose Portion |
| 36 | Tail |
| 38 | Rotational Guide |
| 40 | Rivet Island |
| 42 | Rivet |
| 46 | Primary Score Opening Hinge |
| 50 | Primary Score Termination Feature |
| 54 | Transition Zone |
| 55 | Void |
| 58 | Secondary Score |
| 62 | Secondary Score Termination Feature |
| 66 | Tab Positioning Stop |
| 70 | Tab Rotation Guide |
| 74 | Secondary Score Hinge |
| 78 | Stiffening Bead |
| 80 | Third Gate |

-continued

| | |
|---|---|
| 82 | Rotation Limit |
| 84 | Rivet Island Rotation Guide |

It should be understood that the drawings are not necessarily to scale. In certain instances, details that are not necessary for an understanding of the invention or that render other details difficult to perceive may have been omitted from these drawings. It should further be understood that the invention is not limited to the particular embodiments illustrated in the drawings.

DETAILED DESCRIPTION

Various embodiments of the present invention are described herein and as depicted in the drawings. It is expressly understood that although FIGS. 1-8 depict a metal end closure with a pull tab and at least one secondary vent opening, the present invention is not limited to these embodiments.

Referring now to FIG. 1, a top plan view of a metal end closure according to one embodiment is shown, and wherein a first opening portion is in a first closed position. An end closure adapted for interconnecting to a container body is shown wherein the end closure comprises a panel 14 with a primary opening area 28 and a secondary opening area 32. In one embodiment, a primary opening area 28 comprises a first gate 26 which is defined by a primary score line 30 when the primary opening area 28 is in a first closed position. A primary opening area 28 of the present invention may comprise, for example, portions of material capable of being at least partially separated from and retained by a remainder of the central panel. The primary opening area 28 is at least initially separated from a secondary opening area 32 and secondary gate 27 by a primary opening hinge 46. The primary opening hinge 46 facilitates the selective opening of a primary opening area 28 by a nose of a pull tab or other firm force applying means without simultaneously opening a secondary opening area 32. Force applying means of the present invention may include, but are not limited to, a tab 34 comprising a nose portion 35 and a rivet 42 in communication with a rivet island 40 and a tail 36. As the tail 36 is pulled upward, the nose 35 is driven downward to shear the score line 30 and initiate opening.

In one embodiment, a secondary score 58 starts at the end of a first transition zone (54, in FIG. 4B) and allows for fracture propagation to the secondary score termination feature 62, thus creating a vent feature when the appropriate force is applied. In various embodiments, secondary scores 58 of the present invention may be straight or curved at various angles. Secondary score termination features 62 of the present invention are provided to generally define or limit the propagation of a secondary score 58. In one embodiment, a secondary score termination feature 62 comprises a curved profile for facilitating the prevention of propagation of a score line and creating a desirable venting shape.

Furthermore, the present invention contemplates a secondary score hinge 74. The secondary score hinge 74 of the present invention is generally defined as a portion of the panel 14 residing between a terminus of a secondary score line and a point on the panel 14 proximate to the rivet 42. In one embodiment, hinges of the present invention are disposed at a location relative to the tab 34 such that the hinge serves as a point of rotation for a portion of material, such as a secondary gate 27.

In one embodiment, first 46 and second 74 hinges are disposed on a central panel in a region defined between approximately 0 and 240 degrees (i.e. with zero degrees corresponding to a center line of a tab as shown in FIG. 1). One of skill in the art will recognize that a secondary opening portion 32 may be disposed in a variety of locations, either adjacent or non-adjacent to the primary opening area 28 so long as adequate room is provided for a primary opening area 28.

In general, a tab 34 is provided on the end closure 10 which is rotatably secured on the end closure 10 via "pivot means." Pivot means may include, but are not limited to, a rivet 42 secured to the central panel 14 and which engages a portion of the tab 34, such as a rivet island 40. In one embodiment, the pivot means allows the tab 34 to rotate on the central panel 10. In various embodiments, a tab 34 is oriented generally perpendicular with respect to a longitudinal length of the container, with the longitudinal length of the container defining a center of rotation of the tab 34. As one of ordinary skill in the art will recognize, when a portion of a tab 34 of the present invention is lifted and leveraged about a point generally defined by the location of a rivet 42, a downward opening force is applied to a gate 26 of a first opening portion 28 of the present invention. The downward force will shear a gate 26 away from the panel 14 at the primary score 30, propagating around the score 30 until an opening is formed and thus allowing the container contents to pour out.

The present invention further contemplates a secondary opening area 32, generally defined by a secondary score line 58, a primary score opening hinge 46, and a transition zone 54. In one embodiment, the primary score opening hinge 46 of the present invention is created by the initial fracture proximal to the rivet 42 which propagates around the primary score 30 to the primary score termination feature 50. When the fracture reaches the primary score termination feature 50, the tab 34 will be disposed approximately perpendicular to the panel 14, thus resulting in a force applied by the tab 34 upon the gate 26 in a direction that is substantially perpendicular to a longitudinal axis of a container. As one of ordinary skill in the art will recognize, the tab 34 in this position will generally bend the gate 26 as opposed to further tearing, shearing, fracturing, etc. the gate 26. Furthermore, as will be described in more detail, a primary score termination feature 50 is provided which dictates the general area at which the primary score fracture propagation will terminate.

In one embodiment, a transition zone 54 is provided on the central panel 14. Transition zones 54 of the present invention generally comprise an area that inhibits fracture propagation of a primary score 30 into the secondary score 58 and thus helps prevent the unintentional opening of a secondary opening area 32. For example, a transition zone 54 of the present invention may terminate propagation of a primary score 30 fracture due to a score residual depth, interferences in score path (e.g. a check slot), a predetermined void distance between primary 30 and secondary 58 scores, and/or various combinations thereof including, but not limited to, increased material thickness. In one embodiment, a secondary opening area 32 of the present invention is preferably positioned so that the opening area 32 generally spans a lateral midline of the central panel 14 (i.e. a line running laterally through a rivet 42 disposed in the center of a central panel 14 as shown in FIG. 1). One of ordinary skill in the art will appreciate, however, that the location of the secondary opening area 32 may be altered and/or repositioned in a variety of locations.

As will be understood by one of ordinary skill in the art, a secondary opening area 32 may be positioned on either side of a tab 34 of the present invention. In one embodiment, the present invention 10 contemplates a plurality of optional opening areas 32 in addition to a primary opening area 28. For example, in one embodiment, auxiliary opening areas 32 are provided on both sides of a tab 34 of the present invention as will be described in more detail.

In alternative embodiments, a first opening area and a secondary opening area are opened or severed through the use of an additional or external tool, such as a known can openers and "church keys." Thus, in various embodiments, permanent features such as rivets and tabs need not be provided on central panels in accordance with the present invention. Rather, areas of a central panel may be opened through the use of additional tools.

Figure 2:
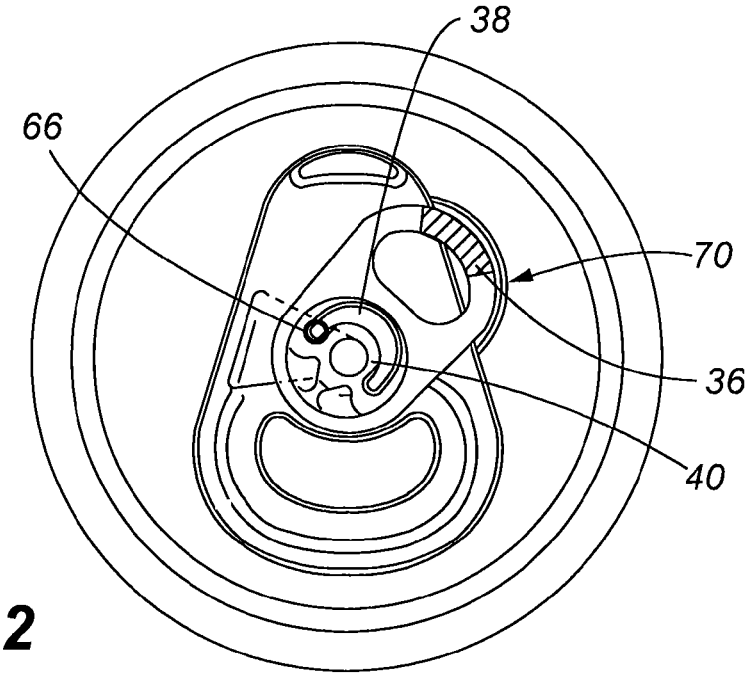
FIG. 2 is a top plan view of a metal end closure according to one embodiment wherein a tab has been rotated to a second position.

Referring now to FIG. 2, a top plan view of a metal end closure according to one embodiment is shown where a tab has been rotated to a second position. As previously discussed, a pull tab 34 may be connected to a panel by a rivet 42 in a manner that allows for rotation of the pull tab. In one embodiment, a tab 34 of the present invention comprises an apparatus which limits the amount of rotation of the pull tab to a predetermined position. Rotation limiting means include, but are not limited to, stationary protrusions and/or depressions disposed on a panel 14 adapted for contacting additional parts of a central panel, such as a tab 34 or rivet island, as well as various other similar features as will be recognized by one of skill in the art. For example, in certain embodiments, a rotational guide 38 is provided which is adapted to help guide, define, and/or limit the path and/or amount of rotation of a tab 34. In other embodiments a tab positioning stop 66 is provided on a central panel so as to limit the amount of rotation achieved by a tab 34. Tab positioning stops 66 of the present invention may be comprised of protrusions stamped from a central panel 14 to form a deboss or may comprise additional features, elements, or material added to a central panel 14. In other embodiments, rotation may be defined and/or limited by features that have been added or joined to a panel 14, in addition to or in lieu of protrusions, indentations, or profiles formed from a panel 14.

It is thus one aspect of the present invention to provide a rotational positioning stop 66 which inhibits the rotation of a tab 34 beyond a predetermined point corresponding to a preferred position of a tab 34 for opening of a secondary opening area 32. For example, in one embodiment, at least one peripheral wall portion of a rotation guide 38 abuts a rotational positioning stop when the tab 34 is rotated to a position where subsequent lifting of the tab 34 will open a secondary opening area 32 with the least amount of force and/or damage to the central panel 14.

In another embodiment, a tab rotation guide 70 or debossed profile may be provided on a panel 14 to guide and/or limit the rotation of a tab 34, either in addition to or in lieu of a tab positioning stop 66 and rotation guide 38 arrangement. For example, a debossed profile 70 may be provided to physically prevent the rotation of a tab 34 beyond a given point by contacting a portion of the perimeter edge of the rotation guide 70, and/or provide visual information to a user as to a maximum preferred limit of rotation of a tab 34.

Figure 3A:
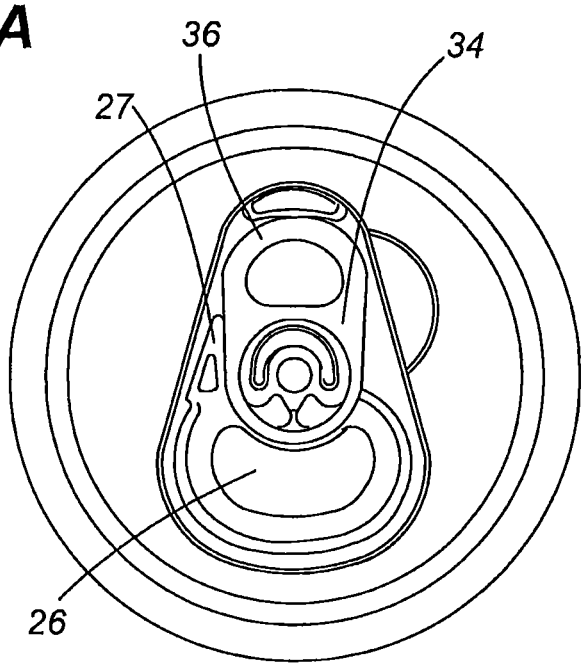
FIG. 3*a* is a top plan view of a metal end closure according to one embodiment wherein a tab and a first opening portion are in a first closed position.

Referring now to FIGS. 3A, 3B, 3C, and 3D, top plan views depicting an opening sequence of one embodiment of the present invention 10 are provided. FIG. 3A is a top plan view of a metal end closure according to one embodiment wherein a tab and a first opening portion are in a first closed position. A panel 14 is depicted, the panel 14 having a first opening area 28 with a gate 26 in a first closed position, a secondary opening area 32 with a secondary gate 27 in a first closed position, and a tab 34 attached to a rivet 42 in an initial position.

Figure 3B:
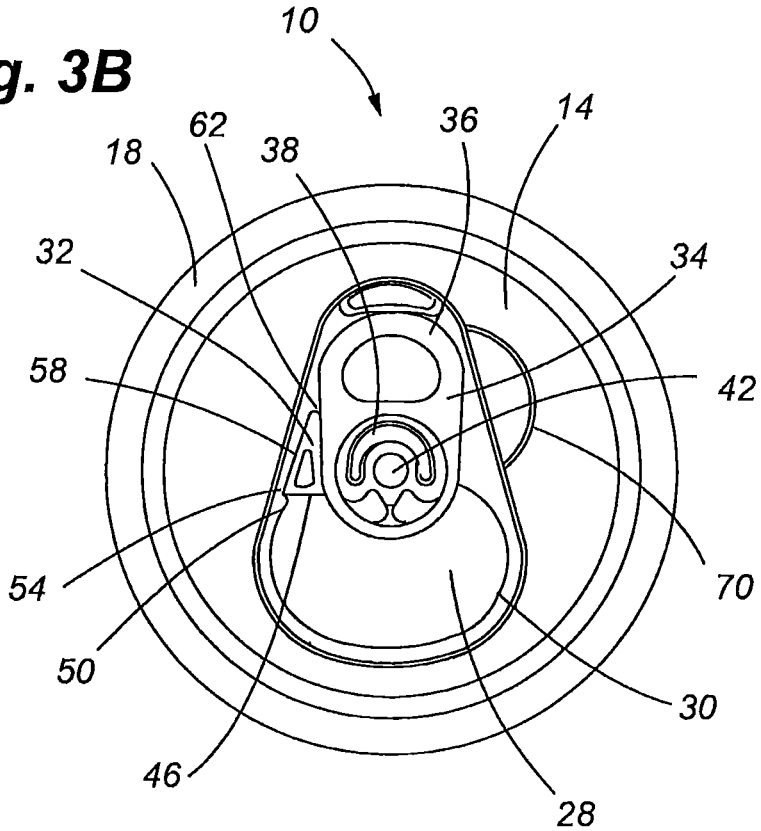
FIG. 3*b* is a top plan view of a metal end closure according to one embodiment wherein a gate of the first opening portion has been opened.

FIG. 3B is a top plan view of a metal end closure according to another embodiment of the invention, wherein a gate of the first opening portion has been opened. A central panel 14 is shown wherein a tab 34 has been lifted or tilted such that a gate has been sheared away from a portion of the panel 14 about a primary score line 30. Thus, a first opening area 28 has been opened to allow for contents to be poured or extracted from the container. As shown in FIG. 3B, a secondary gate 27 remains intact subsequent to the opening of a primary gate. As previously discussed, the secondary gate 27 and secondary opening area 32 are allowed to remain closed when a tab 34 is activated to open a primary opening area 28 and primary gate, due in part to a transition zone 54, primary score termination feature 50, and a primary score opening hinge 46. Accordingly, a central panel of the present invention provides a user with the option to selectively open only a first opening portion 28 where, for example, a vented feature is not desired.

Figure 3C:
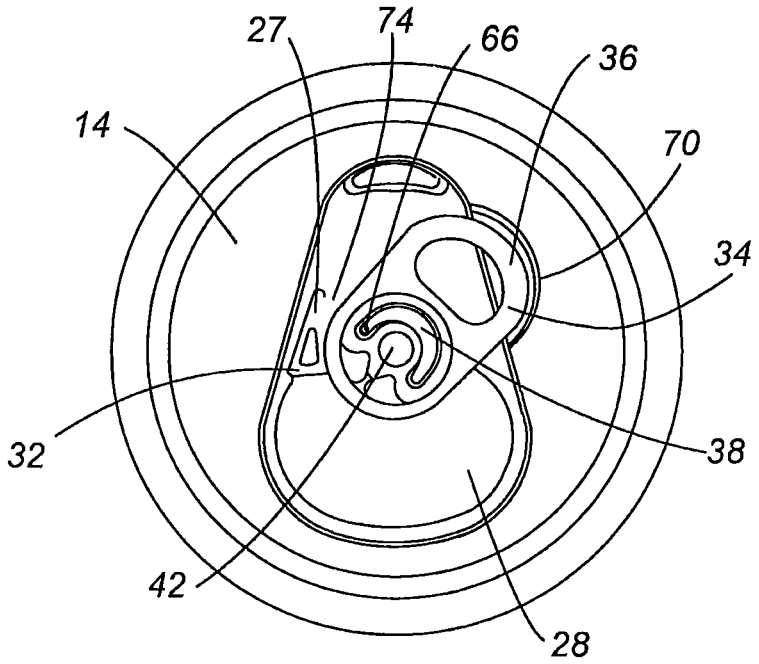
FIG. 3*c* is a top plan view of a metal end closure according to one embodiment wherein a gate of the first opening portion has been opened and a tab rotated to a second position.

Referring now to FIG. 3C, a top plan view of a metal end closure according to one embodiment is provided, where a gate of the first opening portion has been opened and a tab rotated to a second position. A metal end closure is provided wherein a first opening area 28 has been opened and a tab 34 rotated to a second position for subsequent opening of a secondary gate 27 and secondary opening area 32. As previously discussed, a tab 34 of the present invention may be rotatably affixed to a panel 14 via a rivet 42. Thus, the tab 34 is capable of being rotated to a position wherein a second lifting or tilting action applies a downward force upon a secondary gate 27. As further shown in FIG. 3C, rotation limiting means include, but are not limited to, a debossed profile 70 adapted to border, outline, receive, etc. the geometry of one end of a tab 34 of the present invention. Rotation limiting means may also include, for example, a positioning stop 66 disposed on the panel 14 which protrudes a predetermined height from a panel 14 and is adapted to receive and/or limit the rotation of a tab 34 by communicating with a rotational guide 38 formed within the tab 34. In one embodiment, rotational limiting means of the present invention 10 visually identify a preferred position at which a tab 34 should be rotated before tilting or activating a tab 34 and/or limit rotation to a desired predetermined range in order to fracture a secondary score line 62 and open a secondary opening area 32.

Figure 3D:
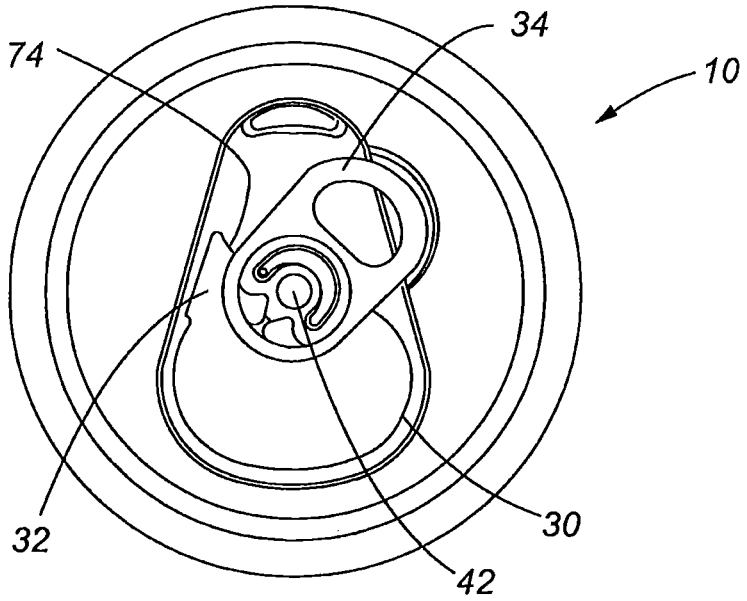
FIG. 3*d* is a top plan view of a metal end closure according to one embodiment wherein a gate of the first opening portion has been opened, a tab rotated to a second position, and a second opening portion opened.

Referring now to FIG. 3D, a top plan view of a metal end closure according to one embodiment is provided, wherein a gate of the first opening portion has been opened, a tab rotated to a second position, and a second opening portion opened. As shown, a rotatable tab 34 of the present invention has been rotated to a second position wherein the tab 34 has been lifted or tilted to apply a downward force on a second gate, thus shearing the gate from a secondary score line and deflecting the gate about a secondary score opening hinge 74. Once the tab 34 is rotated to an appropriate extent and/or degree to open the optional vented area 32, the tab 34 may be returned to a position substantially parallel with the panel 14. Contents housed within the container 10 may then be poured and/or consumed through the first opening portion 28 wherein the second opening area 32 facilitates flow of contents from the container 10 by increasing air flow into the container 10 and reducing vacuum pressure within the container and facilitating liquid flow from the container 10. Furthermore, as previously discussed and as shown in FIG. 3B it is not necessary for a user to open the secondary opening portion 32 of the present invention when a more conventional end closure opening is desired. One of ordinary skill in the art will recognize that various sized vent apertures 32 may be provided on the present invention. In one embodiment, the surface area of the optional vent aperture 32 may comprise an area approximately between 2 and 40 percent of an original score aperture area.

In an alternative embodiment, features of the present invention 10 may be incorporated into an end closure 14 that allows for complete opening of a vented aperture area 32 in a single opening or tab-tilting motion. Thus, in one embodiment, the present invention 10 does not comprise a transition zone 54 as shown and described herein. Rather, a secondary opening area 32 with a single secondary score opening hinge 74 may be provided wherein fracture of a primary score line 30 is not prevented from propagating into a secondary opening area 32 upon a first opening motion and/or force.

In one embodiment, a central panel is provided wherein at least one transition zone is provided between first and second opening areas which does not require rotation of a tab in order to sever a first and second score line. For example, a transition may be provided which requires a two distinct forces in order to sever first and second score lines wherein the two distinct forces are not necessarily segregated or defined by the rotation of a tab.

In one embodiment, a central panel is provided wherein the central panel has a primary score opening area between 0.50 and 0.75 square inches. In another embodiment, the primary opening area has an area between 0.575 and 0.625 square inches. In a more preferred embodiment, the primary opening area has an area of approximately 0.6111 square inches.

In one embodiment, a secondary opening area is provided having an area between 0.020 and 0.20 square inches. In another embodiment, a secondary opening area is provided having an area between 0.080 and 0.10 square inches. In a more preferred embodiment, a secondary opening area is provided having an area of approximately 0.0916 square inches.

In one embodiment, the total opening or open-able area, i.e. the combined area of all opening areas provided on a central panel, is between 0.25 and 1.5 square inches. In another embodiment, the total opening area of a central panel is between 0.60 and 0.80 square inches. In a more preferred embodiment, the total opening area of an end closure is approximately 0.7027 square inches. Thus, in one embodiment, a secondary opening area comprises approximately 13.03% of the total opening area provided on a central panel. However, as will be appreciated by one of ordinary skill in the art, primary and/or secondary opening areas may be varied in size. Thus, in various embodiments, a secondary opening area comprises between 5.0% and 25.0% of the total opening area.

In various embodiments, end closures provide a focal point for air entry into a container body, thus enhancing pourability and flow rates from a container. In various embodiments, secondary vent openings as shown and described herein increase the flow rate of contents from within a container and provide for up to a 30% faster flow of container contents when compared with conventional end closures having only a single opening area. In one particular embodiment, the time required to pour 12 fluid ounces of contents from an end closure of the present invention was approximately 4.35 seconds, compared to approximately 5.5 to 6.0 seconds as required for pouring the same or similar amounts of fluid from conventional end closures.

As will be recognized by one of ordinary skill in the art, area as used herein refers to the surface area of various opening portions as defined by their respective score line as shown and described herein.

Figure 4A:
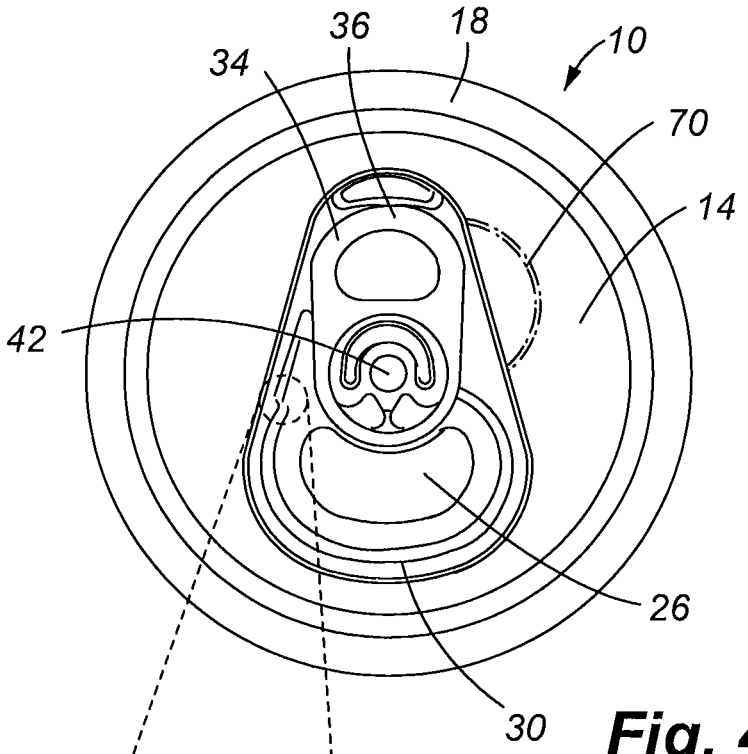
FIG. 4*a* is a top plan view of a metal end closure and a termination zone according to one embodiment.
Figure 4B:
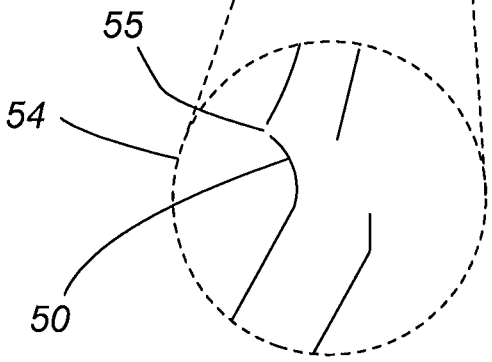
FIG. 4*b* is a detailed top plan view of a metal end closure and a termination zone according to an alternate embodiment.

Referring now to FIGS. 4A and 4B, top plan views of one embodiment of the present invention 10 are shown with a detailed view of a transition zone 54 provided. As shown in the detailed view, a primary score line 30 comprises a primary score termination feature 50 at one terminus. Primary score termination features 50 of the present invention dictate at least a general area at which the propagation of fracture of a primary score 30 will terminate. In one embodiment, as shown in FIG. 4, the primary score termination feature comprises a curvature in the primary score line 30 which represents a departure from the general path of the score line 30. In one embodiment, the termination feature 30 of the present invention is disposed within a transition zone 54 which further comprises a gap or void 55 which further inhibits propagation of a fracture of a first score line 30 into a second score line 58. In one embodiment, a void 55 of the present invention comprises a width approximately between 0.001 inches and 0.035 inches. In a preferred embodiment, a void 55 of the present invention comprises a width approximately between 0.005 inches and 0.025 inches. In a more preferred embodiment, a void 55 of the present invention comprises a width approximately between 0.012 inches and 0.015 inches.

Figure 5:
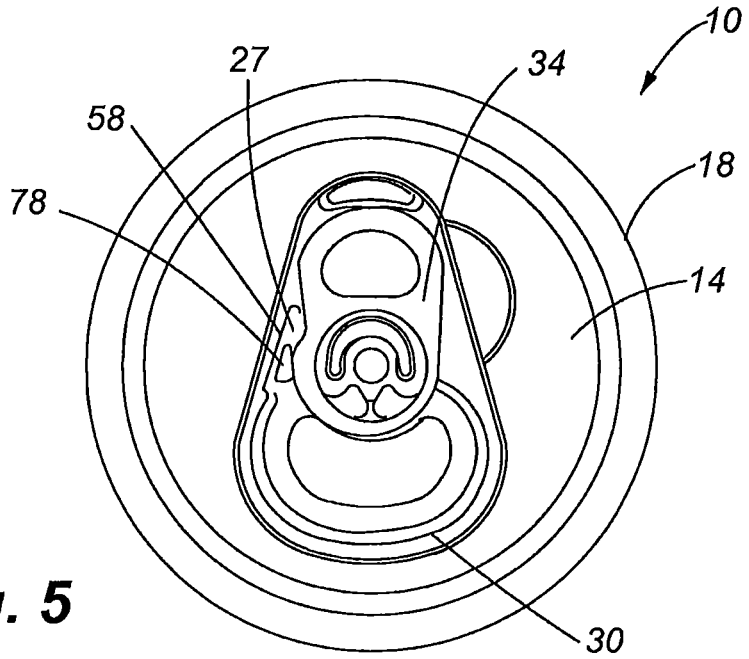
FIG. 5 is a top plan view of a metal end closure comprising an asymmetric tab according to an alternate embodiment.

Referring now to FIG. 5, a top plan view of a metal end closure comprising an asymmetric tab 34 is shown. The tab 34 is provided having an asymmetric geometry that is adapted to open a first 30 and secondary score feature 62 with a single or double opening operation (e.g. lifting of the tab 34). More specifically, the tab 34 includes an asymmetric protrusion or extension which extends over a secondary opening portion 32 that is adapted to contact a secondary gate 27 of a secondary opening area 32.

In one embodiment, the central panel 10 comprises a secondary opening portion 32 with a stiffening bead 78. One of skill in the art will recognize that the stiffening bead 78 disposed on the secondary opening area 32 may be comprised of any number of shapes (e.g. square, round, oval, polygonal, etc.). Embossed and/or debossed stiffening beads 78 may be disposed on secondary gate 27 of the present invention in order to stiffen the score panel 27 and facilitate proper rupture of the secondary score line 58 during opening. It will be recognized by one skilled in the art that the score panel design requires careful balancing of dimensions and design parameters in order to ensure that opening areas and other portions of a central panel will remain closed at appropriate times (e.g. during packaging and shipping operations) yet capable of opening under a reasonable amount of user-applied force. Accordingly, it is contemplated that a secondary opening area 32 of the present invention comprises one or more emboss and/or deboss beads.

In one embodiment, a stiffening bead area comprises a width approximately between 0.10 inches and 0.50 inches. In a preferred embodiment, a stiffening bead area comprises a width approximately between 0.20 inches and 0.40 inches. In a more preferred embodiment, a stiffening bead area comprises a width approximately between 0.225 inches and 0.275 inches. In one embodiment, a stiffening bead area comprises a length approximately between 0.20 inches and 0.60 inches. In a preferred embodiment, a stiffening bead area comprises a length approximately between 0.30 inches and 0.50 inches. In a more preferred embodiment, a stiffening bead area comprises a length approximately between 0.375 inches and 0.425 inches.

Figure 6:
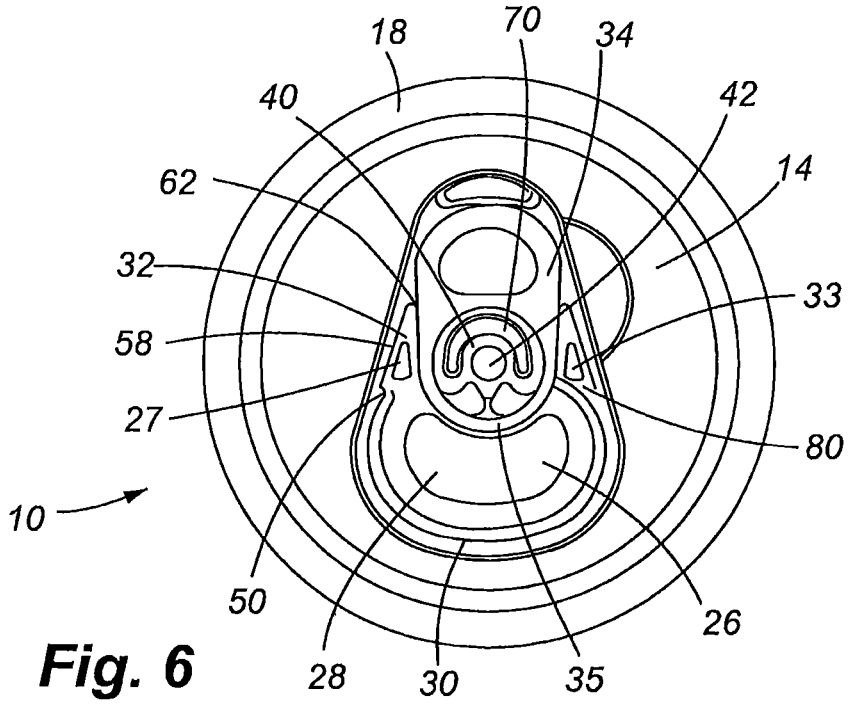
FIG. 6 is a top plan view of a metal end closure according to an alternate embodiment comprising two optional opening areas.

FIG. 6 is a top view of a metal end closure according to one embodiment wherein two optional vent opening features 32, 33 are provided. As shown, a first opening area 28 is disposed on a central panel with secondary 32 and third 33 opening areas disposed adjacent thereto. In embodiments, a third opening area 33 comprises the same features and functions as the secondary opening area 32 as described herein. Thus, in certain embodiments, a first opening area 28 may be opened by applying downward force via a nose portion 35 of a tab 34. The tab 34 may then be repositioned in a manner that allows for rotation of the tab 34. The tab 34 may then be rotated such that a nose portion of the tab 34 is disposed at least partially over a secondary 32 opening area and the tab 34 tilted or lifted to apply a downward pressure upon the secondary opening area 32 and separating a secondary gate 27. Subsequently, the tab 34 may again be tilted or restored to a position that allows for rotation of the tab and the tab 34 rotated such that it is at least partially disposed over the third opening area 33. The tab 34 may then tilted or lifted such that a nose portion of the tab 34 applies a downward pressure on the third opening portion 33 and separates a third or tertiary gate from the panel. The tab 34 may then remain in a final position or repositioned based on user preference and container contents poured smoothly as facilitated by the plurality of optional vent openings.

In certain embodiments, secondary and third gates may be opened without the need to rotate a tab 34. For example, in one embodiment, both a secondary gate 27 and third gate 80 may be severed from a panel 14 along their respective score lines due to the application of a force applied by the tilting or lifting of a tab 34 that is distinct from the tilting or lifting of tab 34 used in opening or severing a first gate 26. Features of the present invention allow for the tab 34 to be lifted under one distinct force or motion capable of severing a primary gate 26. Subsequent to the application of this force, an additional distinct force may be applied in series so as to open secondary and third gates.

Figure 7:
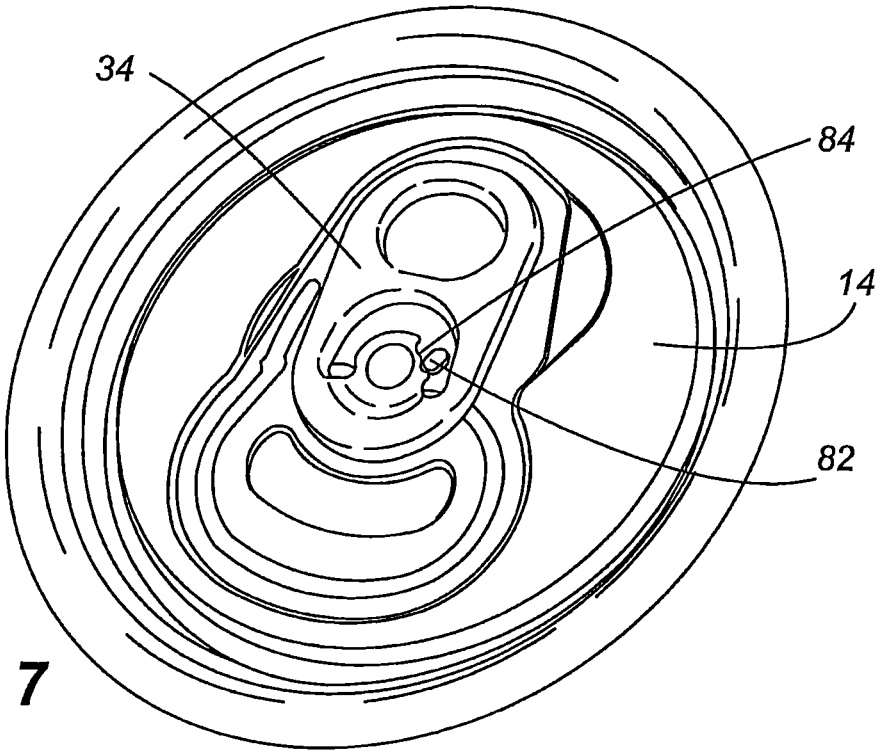
FIG. 7 is a top perspective view of a metal end closure according to an alternate embodiment comprising a rotation stop guide and a rivet island in a first position.
Figure 8:
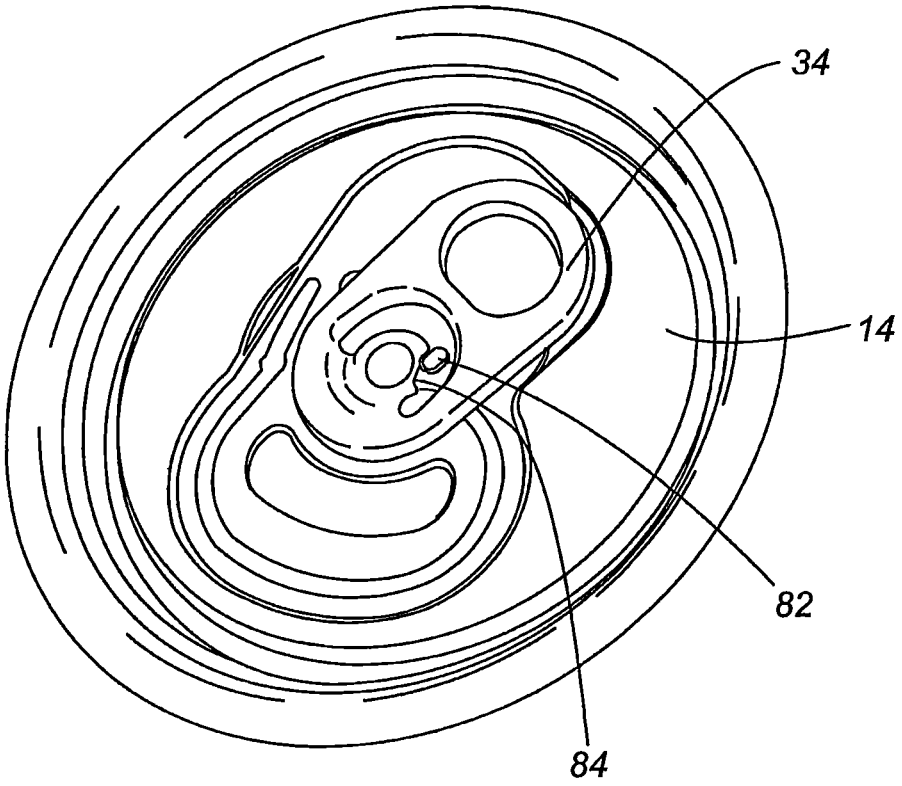
FIG. 8 is a top perspective view of a metal end closure according to one embodiment comprising a rotation stop guide and a rivet island in a second position.

Referring now to FIGS. 7 and 8, top perspective views of a metal end closure 10 according to one embodiment are provided. As shown, a rotational limiting means may be provided to prevent the rotation of a tab 34 beyond a certain position. Rotational limiting means of the present invention include, but are not limited to, protrusions and indentations of the panel 14 capable of communicating with portions of a tab 34. For example, as shown in FIG. 7, a protrusion may act as a rotation stop guide 82 adapted to interact or communicate with a portion of a rivet island 84. In certain embodiments, a peripheral portion of a segment of the rivet island 84 contacts a peripheral portion of the rotation guide 82 in a first position. Contact between the guide 82 and rivet island portion 84 in a first position corresponds to the tab 34 being disposed in a position adapted for opening of a primary opening area 28. Contact of a rotation guide 82 and a rivet island 84 facilitates the prevention of rotation beyond a certain point without constricting or limiting a tab's 34 ability to tilt and apply a downward pressure upon one or more opening areas.

As shown in FIG. 8, a tab 34 has been rotated to a maximum allowable extent as defined by a second point of contact between a rivet island portion 84 and a rotational guide 82. As will be recognized, the maximum amount of rotation allowed by the rivet island portion 84 and rotational guide 82 corresponds to a rotational positional of the tab 34 which is adapted for easy opening of one or more optional vent openings as described herein.

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more embodiments for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the disclosure.

Moreover, though the present disclosure has included description of one or more embodiments and certain variations and modifications, other variations and modifications are within the scope of the disclosure, e.g. the use of disposable components comprising some or all of the apparatus described herein, as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A container end closure with a peripheral curl adapted for interconnection to a neck of a container, comprising:

a central panel with a first tear panel which defines a first opening portion and a second tear panel which defines a vent opening portion;

a pull tab adapted for applying a downward force on a predetermined portion of said first tear panel and said second tear panel;

a rivet operatively interconnecting said pull tab on an upper surface of said central panel and allowing said pull tab to rotate a predetermined distance in a plane which is substantially parallel to said central panel;

said first opening portion defined by a first severable score line and a first hinge portion;

said vent opening portion defined by a second severable score line and a second hinge portion, said vent opening portion positioned substantially adjacent to said first opening portion; and a transition portion comprising a gap between the first severable score line and the second severable score line, wherein the first severable score line and the second severable score line are non-contiguous and the transition portion is adapted to substantially prevent a fracture propagation of said first severable score line into said second severable score line;

and wherein said first opening portion and said second opening portion can be selectively opened with said pull tab to form a contiguous opening area which includes the area defined by said first opening portion and said vent opening portion.

2. The container end closure of claim 1, wherein said gap comprises a width between approximately 0.012 inches and 0.015 inches.

3. The container end closure of claim 1, further comprising a third opening portion defined by a severable score line and a third hinge portion integral with said central panel.

4. The container end closure of claim 1, wherein said central panel comprises an upwardly projecting protrusion adapted for contacting said tab and preventing rotation of said tab beyond a predetermined location.

5. The container end closure of claim 4, wherein said protrusion is disposed within an area defined by said tab and wherein an inner peripheral portion of said tab is adapted to contact a peripheral portion of said protrusion.

6. The container end closure of claim 1, wherein said central panel comprises a visual indicator displaying a desirable amount of rotation of said tab to sever said second tear panel.

7. The container end closure of claim 1, wherein said vent opening portion comprises an area that is between about 5% and 25% of the combined area of said first opening portion and said vent opening portion.

8. The container end closure of claim 1, wherein said second opening portion is positioned at an angle of between about 90-120 degrees from the initial longitudinal orientation of said pull tab.

* * * * *